United States Patent [19]

Farber

[11] Patent Number: 4,907,477

[45] Date of Patent: Mar. 13, 1990

[54] APPARATUS FOR REMOVING BASE OF BROKEN LAMP FROM A SOCKET

[76] Inventor: Melvin A. Farber, 8901 Turton Dr., Philadelphia, Pa. 19115

[21] Appl. No.: 227,064

[22] Filed: Aug. 1, 1988

[51] Int. Cl.[4] ..... B25B 7/02

[52] U.S. Cl. ..... 81/302; 81/416; 81/427; 81/900

[58] Field of Search ..... 81/302, 416, 900, 427.5, 81/427; 29/764; 445/2

[56] References Cited

U.S. PATENT DOCUMENTS 1,305,873 6/1919 Briggs ..... 81/427.5 X 2,334,781 11/1943 Maines ..... 81/302

3,398,746 8/1968 Abramson ..... 81/302 X 3,833,953 9/1974 Fisher et al. ..... 81/416 X

FOREIGN PATENT DOCUMENTS 641521 6/1962 Italy ..... 81/427.5

*Primary Examiner*—Kenneth J. Ramsey

*Attorney, Agent, or Firm*—Woodcock Washburn Kurtz Mackiewicz & Norris

[57] ABSTRACT

An apparatus and method are provided for removing a lamp base from the socket into which it has been installed, after its bulb has been broken.

5 Claims, 3 Drawing Sheets

APPARATUS FOR REMOVING BASE OF BROKEN LAMP FROM A SOCKET

BACKGROUND OF THE INVENTION

A. Field of the Invention

This invention pertains to a tool for removing lamps, and more particularly to a tool for removing the base of a lamp whose bulb has been broken.

Incandescent lamps typically feature screw-type bases. Such lamps are installed by grasping the glass bulb of the lamp, inserting the base into its intended socket and then rotating the lamp so that the mating screw threads on the lamp base and socket pull the lamp into the socket until it is firmly seated, thus making the contact necessary to complete the electrical circuit. The rotative force necessary for this method of installation is supplied manually and is applied by a firm hand grip on the glass bulb of the lamp. Removal of the lamp is accomplished by a similar procedure except that the rotative force is applied in the opposite direction.

Due to the fragile nature of the glass bulb, combined with its typical use in an exposed location without substantial protection, it frequently happens that sometime after installation the bulb shatters as the result of an inadvertent contact with another object, or the glass bulb otherwise becomes removed from the lamp base. Replacement of the lamp requires removal of the screw base. However, in such circumstances the glass bulb is no longer available as a means of grasping the lamp and applying the rotative force necessary to unscrew the base. The difficulty of this situation is further compounded by sharp remnants of the glass bulb still affixed to the base.

B. Description of the Prior Art

In the past the methods utilized for removing the lamp base from its socket after its bulb has been broken involved inserting one's fingers into the screw base or gripping the lip of the screw base with a compression tool, such as a needle-nosed pliers, so that the necessary rotative force can be applied (it should be noted that as a result of airborne particles which frequently attach themselves to the surfaces of the screw threads, the rotative force necessary to remove the screw base may be substantially greater than that applied at installation, depending on the local environment and the elapsed time since the lamp's installation). This procedure is both difficult and time consuming and poses dangers of laceration and electrical shock to the person attempting to remove the lamp base thereby.

It is, therefore, desirable to provide an apparatus and method for removing the lamp base after the bulb of the lamp has been broken which is both safe and efficient.

SUMMARY OF THE INVENTION

The apparatus is comprised of two similar members, each with integral portions defining a jaw and a handle at opposing ends of each member. The members are connected by a pivot joint between the jaws and handles, the pivot joint being disposed closer to the jaws than the handles. Both of the members are comprised of an electrically-insulating material. The apparatus is constructed so that when the handles are moved away from one another (e.g., by the application of an expansive force) the jaws come together, allowing the jaws to be inserted into the lamp base interior. When the handles are moved toward one another (e.g., by the application of a compressive force) the jaws move outward, securely engaging the inner surface of the lamp base, thereby allowing the necessary rotative force to be applied for removal of the lamp base. In accordance with one important aspect of the invention, the exterior surfaces of the jaws are serrated to improve the gripping force of the jaws through increased friction.

In one embodiment of the invention, a spring means is utilized to provide the expansive force so that with the apparatus in its free state the handles are forced apart, thereby moving the jaws together so that they are in position suitable for insertion. Manual force is required to press the handles toward one another thereby moving the jaws outward into the engaged position gripping the inside surface of the lamp base.

In another embodiment, a spring means is utilized to provide the compressive force so that with the apparatus in its free state the handles are urged toward one another, thereby moving the jaws outward. Manual force is required to move the handles outward thereby moving the jaws together in a position suitable for insertion. Upon release of the manual force the spring means urges the handles toward one another thereby moving the jaws outward into the engaged position gripping the inside surface of the lamp base.

DESCRIPTION OF THE PREFERRED EMBODIMENTS

Figure 1:
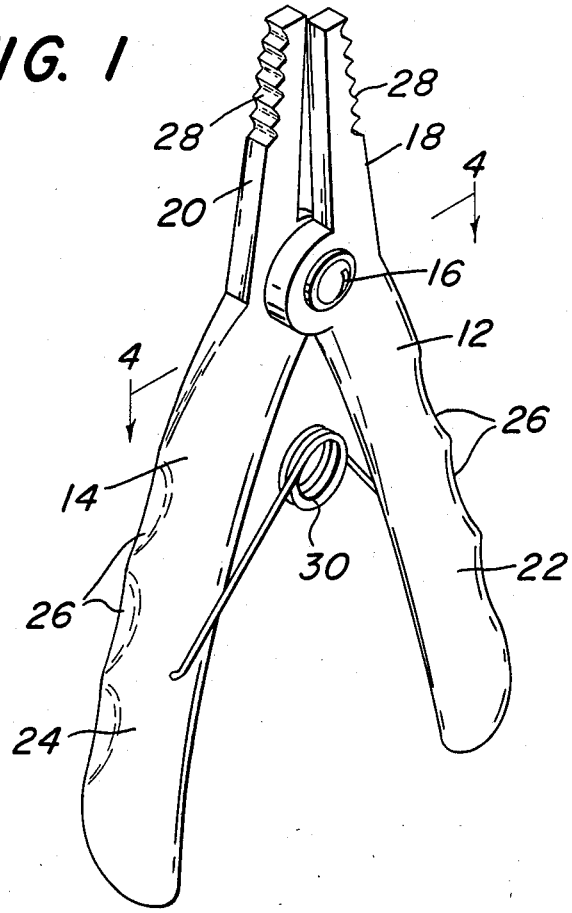
FIG. 1 is a perspective view of one embodiment of an apparatus according to the present invention.
Figure 3:
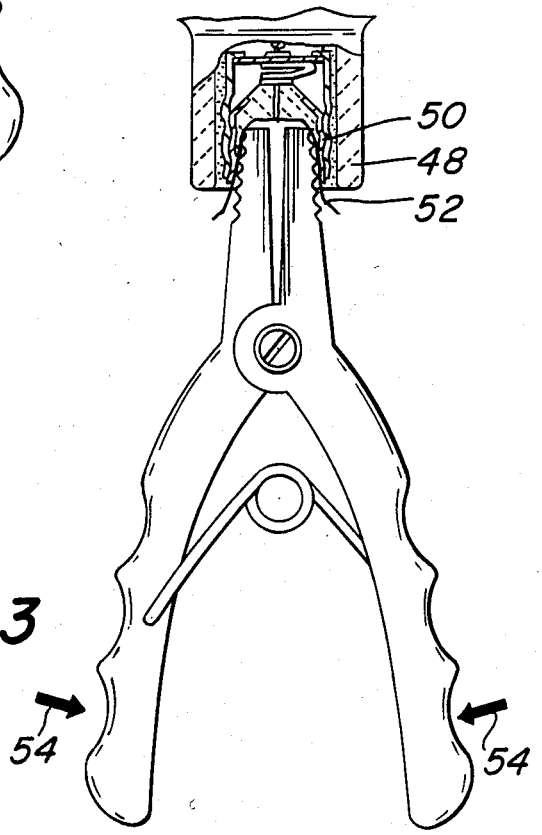
FIG. 3 shows the apparatus of FIG. 1 in its engaged position.

Referring to the drawings, wherein like numerals represent like elements, there is illustrated in FIG. 1 an apparatus 10 which is one of the preferred embodiments of the invention. Member 12 comprises two ends with a jaw 18 at one end and a handle 22 at the other end. Disposed between the jaw and the handle, but closer to the jaw, is a pivot joint 16 whereby member 12 is connected to member 14. Member 14 is similar to member 12 and comprises a second jaw 20 and a handle 24. The jaws of members 12 and 14 are adapted to engage the interior portion of the lamp base 52 as shown in FIG. 3 and feature a means of increasing the ability of the jaws to grip the inside surface of the lamp base. Such means may be accomplished by serrations 28 on the outward facing surfaces of the jaws. The serrations increase the surface pressure exerted by the jaws on the lamp base interior and thus increase the frictional force resisting relative motion between the lamp base and the jaws. It is contemplated that other means may be utilized to increase the gripping ability of the jaws.

The handles of members 12 and 14 feature a means of increasing the ability of the individual utilizing the apparatus to apply manual force to the handles. Such means may be accomplished by finger grips 26 which are comprised of a plurality of concave depressions in the outward facing edges of the handles. The depressions are adapted to the size and spacing of the fingers of an average hand.

Members 12 and 14 are comprised of an electrically-insulated material.

Figure 4:
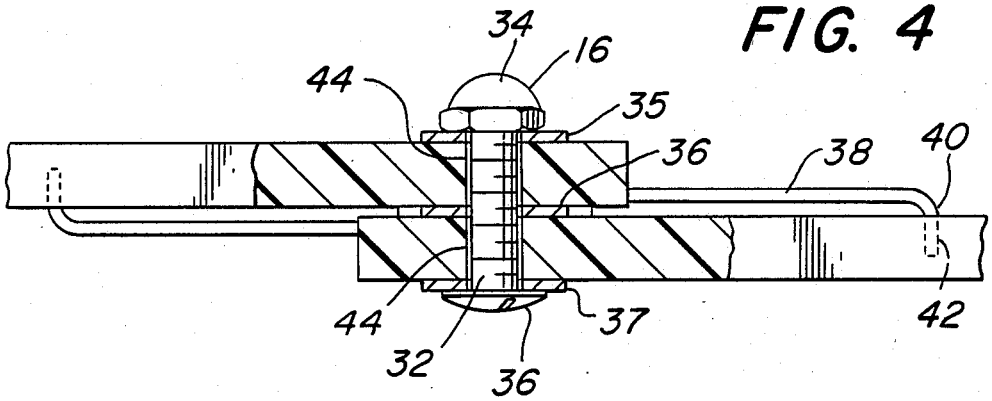
FIG. 4 is a cross section taken through line 4—4 of FIG. 1.

According to the preferred embodiments, members 12 and 14 are connected by a pivot joint 16, as shown in FIG. 4. The pivot joint is similarly located in both members between the jaws and handles. The pivot joint is comprised of a screw 32, disposed through a hole 44 in each of the members, and retained by means of a nut 34 affixed to the screw. The joint features means for reducing the sliding friction associated with the pivoting motion of the members. Such means may comprise washers 35, 36, 37 placed around the screw 32 and disposed between members 12 and 14, between member 14 and the nut 34 and between member 12 and the head of the screw 32.

In both members 12 and 14, the spatial relationship among the jaw, handle and pivot joint is such that when the handles are moved away from each other by application of an expansive force to item the jaws come together. Correspondingly, when the handles are moved toward each other by application of a compressive force to them 54 the jaws move apart.

Figure 2:
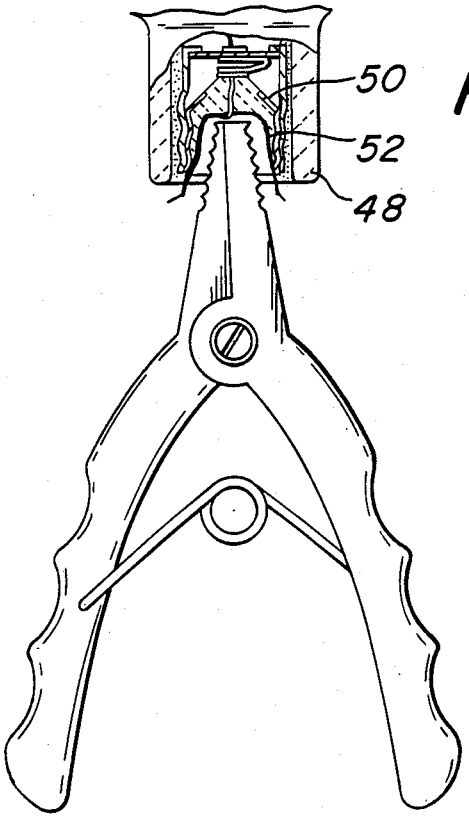
FIG. 2 shows the apparatus of FIG. 1 inserted in a lamp base prior to engagement.

In one embodiment of the invention a spring is utilized to provide the expansive force to urge the handles apart so that without any manual force being applied to the handles, the jaws are closely aligned and ready for insertion into the lamp base interior 52 as shown in FIG. 2. When the spring force is opposed by pressing the handles together manually the jaws move outward and engage the lamp base interior as shown in FIG. 3, the gripping action of the jaws being aided by their serrations. In this embodiment the lamp base 50 is removed from its socket 48 by applying a rotative force through the apparatus while simultaneously applying a compressive force 54 pressing the handles together. The spring means 30 may be a helical torsion spring as shown in FIG. 1. Each end of the spring is comprised of a straight section 38 which terminates in a hook 40. The spring is affixed to the handles by inserting a hook at each end of the spring into a hole 42 in each of the handles.

Figure 5:
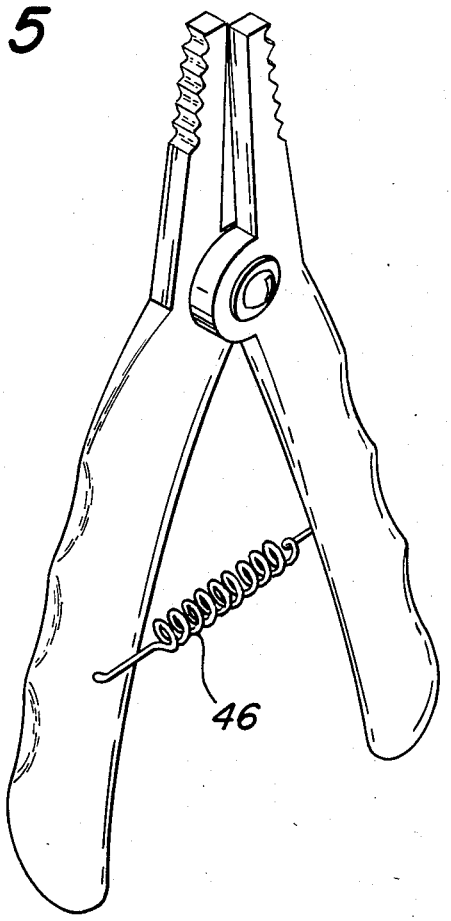
FIG. 5 shows an alternative embodiment of an apparatus according to the present invention.

In another embodiment of the invention a spring is utilized to provide the compressive force to urge the handles together so that without any manual force being applied to the handles the jaws are in their outward position. In order to align the jaws for insertion into the lamp base the handles must be spread apart by application of a manually applied expansive force. After insertion the handles are released and the spring force causes the jaws to engage the lamp base interior. In this embodiment there is no need to manually apply both engagement and rotative force simultaneously in order to remove the lamp base. The spring means may be a helical extension spring 46 as shown in FIG. 5. Each end of the spring terminates in a hook which is utilized to affix the spring to the handles as discussed above.

The present invention may be embodied in other specific forms without departing from the spirit or essential attributes thereof and, accordingly, reference should be made to the appended claims, rather than to the foregoing specifications, as indicating the scope of the invention.

I claim as my invention:

1. In a lamp having a bulb and a lamp base that is insertable into a socket, an apparatus for removing the lamp base from the socket after its bulb has been broken, comprising:

(a) a plurality of jaws adapted to engage the inside surface of the lamp base;

(b) means including handles coupled to the jaws for moving the jaws relative to each other; and, (c) spring means operatively coupled to the handles for urging the handles together and the jaws apart;

whereby the jaws are insertable into the lamp base after application of an expansive force to the moving means to move the jaws together, the spring means urges the jaws apart to engage the inner surface of the lamp base when the expansive force is removed, and thereafter the lamp base is removable from the socket by application of a rotative force to the handles.

2. Apparatus according to claim 1 wherein the spring means comprises a helical extension spring.

3. Apparatus according to claim 2 wherein:

(a) each end of the spring comprises a straight section which terminates in a hook;

(b) a hole is provided in each handle; and, (c) the spring is affixed to the handle by inserting each hook end into a hole.

4. Apparatus according to claim 1 further comprising means for increasing the frictional resistance between the jaws and the lamp base inner surface when the jaws are engaged therein.

5. Apparatus according to claim 4 wherein the jaws have outwardly facing edges and the means for increasing frictional resistance comprises serrations in the outwardly facing edges of the jaws.

* * * * *